US005257658A

United States Patent [19]

Perera

[11] Patent Number: 5,257,658

[45] Date of Patent: Nov. 2, 1993

[54] HANDY CASTING CHAMBER

[76] Inventor: Enrique E. Perera, 1293 Commonwealth Ave. No. 6, Allston, Mass. 02134

[21] Appl. No.: 947,920

[22] Filed: Sep. 21, 1992

[51] Int. Cl.[5] ..... B22D 18/06; B22D 18/00; B22C 21/00

[52] U.S. Cl. ..... 164/255; 164/254; 164/376

[58] Field of Search ..... 164/253, 254, 255, 256, 164/61, 63, 65, 376, DIG. 4, DIG. 15, 7.1; 249/54

[56] References Cited

U.S. PATENT DOCUMENTS

| | | | |
|---|---|---|---|
| 1,244,257 | 10/1917 | Sweetnam | 164/DIG. 4 |
| 1,473,278 | 11/1923 | Burns | 164/376 |
| 1,490,090 | 4/1924 | Burns | 164/376 |
| 1,494,869 | 5/1924 | Sweetnam | 164/255 |
| 2,221,302 | 11/1940 | Mizzy et al. | 164/376 |
| 4,781,237 | 11/1988 | Sing | 164/255 |
| 4,915,155 | 4/1990 | Martin | 164/376 |

FOREIGN PATENT DOCUMENTS

| | | | |
|---|---|---|---|
| 1558139 | 5/1970 | Fed. Rep. of Germany | 164/253 |
| 1590977 | 5/1970 | France | 164/255 |

*Primary Examiner*—Mark Rosenbaum
*Assistant Examiner*—Erik R. Puknys

[57] ABSTRACT

An inexpensive vacuum casting chamber is provided to considerable increase casting production in vacuum assist casting machines. This vacuum casting chamber will increase casting production in vacuum assist casting machines by allowing perforated flask to be casted in said machines.

3 Claims, 2 Drawing Sheets

HANDY CASTING CHAMBER

BACKGROUND OF THE INVENTION

1. Field of the Invention

This invention relates to the lost-wax casting process, more specifically, it relates to an inexpensive vacuum casting chamber to increase production in vacuum assist casting machines. The function of the present invention, may be adapted and employed for a variety of requirements as those skilled in the art will recognize, in the light of the present disclosure.

2. Description of the Prior Art

Since 1969, casting machine manufacturers have marketed several versions of vacuum casting machines, the most popular version being the vacuum assist casting machine. the body of the machine contains a vacuum pump. Allocated at the front of the machine is a switch to actuate the vacuum pump, a vacuum release valve, and a vacuum gauge. The top of the machine serves two purposes, on one side the investment material can be vacuumed, and on the other side a non-perforated flask can be used in casting. After the wax patterns have been enclosed in a flask, a heat resistant plaster compound called an investment, is mixed with water in a rubber bowl, and then placed on top of the machine and under a bell jar to be vacuumed, to eliminate the air trapped in the investment. The investment slurry is then poured into the flask to form the final mold for the metal.

The flask after it has been burned out and has reached the proper casting temperature is placed on the other side of the machine, sprue opening side up and directly over the vacuum hole in the plate (called vacuum table) which is connected to the vacuum pump. A switch is used to actuate the pump, which evacuates air from the flask and draws the molten metal into the flask.

The vacuum assist casting machine is very easy and safe to operate, and is widely used by craftsmen and small casting outfits. But the vacuum assist casting machine has a shortcoming, production is very restricted to only a few wax patterns per flask, because the vacuum is created at the bottom of the flask, only a non-perforated flask can be used with this type of machine, and a tall flask is not recomended for small pieces of jewelry.

In vacuum assist casting machine, the vacuum force acts only in one direction, from the top of the flask downward, and when making the wax tree, the wax patterns have to be attached to the sprue base facing downward, at a very acute angle with respect to the sprue base. By doing this type of treeing, less wax patterns can be attached to the sprue base, this is necessary otherwise castings with voids or incomplete casting will be the result.

There is no alternative for owners of vacuum assist casting machine to increase production with out the need of acquiring a more expensive vacuum chamber casting machine, which utilizes perforated flask.

OBJECTS OF THE INVENTION

It is therefore a general object of this invention to overcome the aforementioned problems associated with the limited production of vacuum assist casting machines.

It is another general object of this invention to provide an inexpensive vacuum casting chamber which is easy and safe to operate.

It is a more specific object of this invention to provide an inexpensive vacuum chamber, when placed on top of the vacuum table of any vacuum assist casting machine, will cast with two different sizes of perforated flask, with out the need of any adaptors or vacuum hose connections.

SUMMARY OF THE INVENTION

The object of this invention is achieved by an inexpensive vacuum casting chamber, having a hollow cylindrical shape, being open at both ends, the openings at the ends are dimentioned to receive in the interior of the chamber two different sizes of perforated flasks, depending on which end of the chamber is up when placed on top and directly over the vacuum hole of the vacuum table of any vacuum assist casting machine.

When ready to cast, a perforated flask that matches with the top opening of the vacuum chamber, is set in the interior of the chamber. The vacuum is actuated, and the vacuum table will create a vacuum in the interior of the vacuum chamber withdrawing the air and gases trapped in the investment material and molds cavities, through the bottom and the holes all around the flask wall. Therefore when the molten metal is poured into the flask it is immediately sucked into the pattern cavities by the pull of the vacuum and the force of atmospheric pressure.

By using this method of casting, the casting production in vacuum assist casting machine will increase considerable. With this vacuum casting chamber there is no need for adaptors, like in other's machines, to cast two different sizes of perforated flask, and no vacuum hose connection, or any means of attachment to fastening the vacuum chamber to the vacuum assist casting machine are needed.

BRIEF DESCRIPTION OF THE DRAWINGS

The present invention will be more clearly understood from the following detailed description read in conjunction with the acçompanying drawings in which.

DETAILED DESCRIPTION OF THE PREFERRED EMBODIMENT

Before describing the invention in detail, will be helpful to explain the general principles of the vacuum table, in a vacuum assist casting machine of any suitable type.

Figure 1:
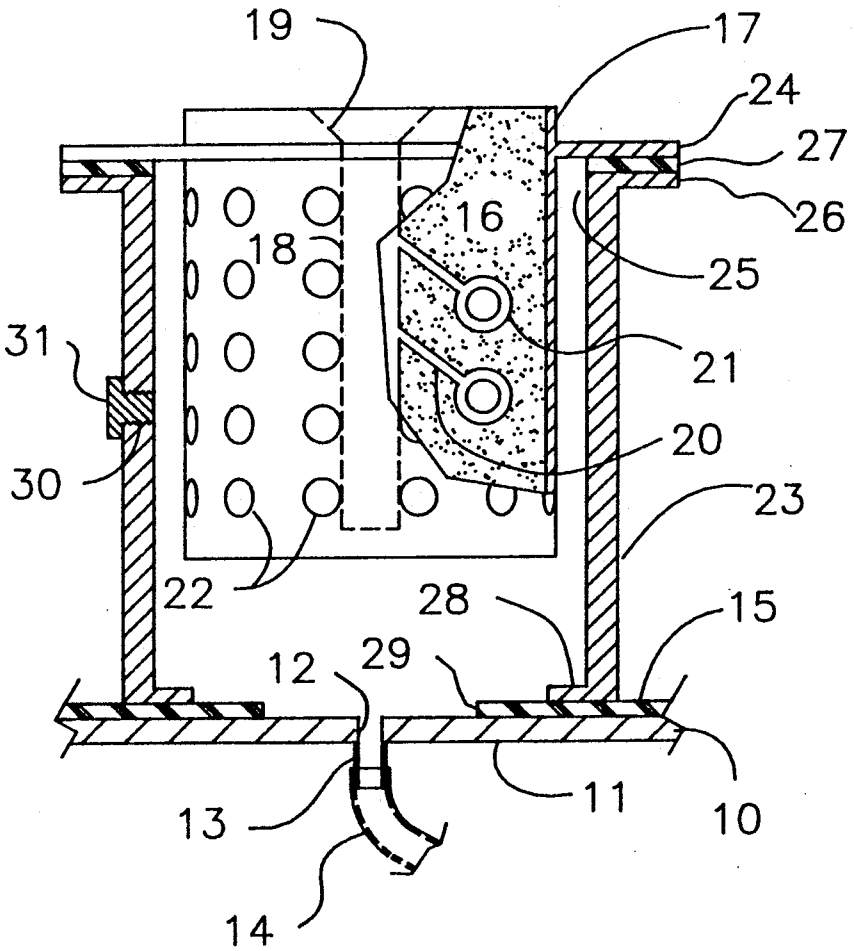
FIG. 1—Depicts a side view of the preferred embodiment of the invention in cross section, and shows a perforate flask in partial cross section.

Referring to FIG. 1 vacuum table 10 (shown in partial view) consist of a flat sheet of metal 11 with a vacuum hole 12 at the center, in which hose fitting 13 is permanently attached one end of the vacuum hose 14 is connected to hose fitting 13 and the other end to the vacuum pump (not shown). When ready to cast a non-perforated flask (not shown) is placed on top of the vacuum table 10 sprue opening side up and directly over vacuum hole 12, a heat resistant gasket 15 provides an air tight seal between the vacuum table 10 and the flask, when the vacuum pump is actuated, the vacuum created at the bottom of the flask by vacuum hole 12, evacuates air and gases from the flask, and draws the molten metal into the flask.

According to the invention, referring to FIG. 1 a heat resistant plaster compound called investment 16 is contained in flask 17 at the core of investment 16 a cylindrical channel 18 extends from the top of investment 16 downward, but not reaching the bottom of investment 16, at the top channel 18 has an opening 19 in a conical shape, to avoid spill and guide the molten metal into the channel 18, a plurality of small channels 20 connect channel 18 with a plurality of cavities 21 in the shape of the article to be cast, flask 17 has a series of holes 22 to permit a great area of investment 16 to be exposed to the interior of chamber 23. From the wall of flask 17 an integral flange 24 extends outward, at the top chamber 23 has an opening 25 dimentioned to receive flask 17, an integral flange 26 extends outward from the upper wall of chamber 23. An O type heat resistant gasket 27 is provided between flange 24 of flask 17 and flange 26 of chamber 23, to provide an air tight seal between chamber 23 and flask 17. an integral flange 28 extends inward from the lower wall of chamber 23, at the bottom chamber 23 has an opening 29 dimentioned to receive a smaller size flask. At one side of chamber 23 a threaded hole 30 with a plug 31 fixed into it is allocated, the function of this assembly will be explained further. When ready to be used, chamber 23 is placed in an upright position on top of the vacuum table 10 and directly over the vacuum hole 12, a heat resistant gasket 15 provides an air tight seal between chamber 23 and vacuum table 10 flask 17 is placed in the interior of chamber 23, an O type heat resistant gasket 27 provides an air tight seal between chamber 23 and flask 17, when the vacuum pump is actuated, vacuum hole 12 will create a vacuum in the interior of chamber 23 withdrawing the air and gases trapped into the investment material 16 and the mold cavities 21 throughout the bottom and openings 22 of flask 17. Therefore as the molten metal is poured into the flask it is immediately sucked into the mold cavities 21 by the absent of air and gases, the pull of the vacuum in the interior of chamber 23, and the force of atmospheric pressure on top of flask 17.

Figure 2:
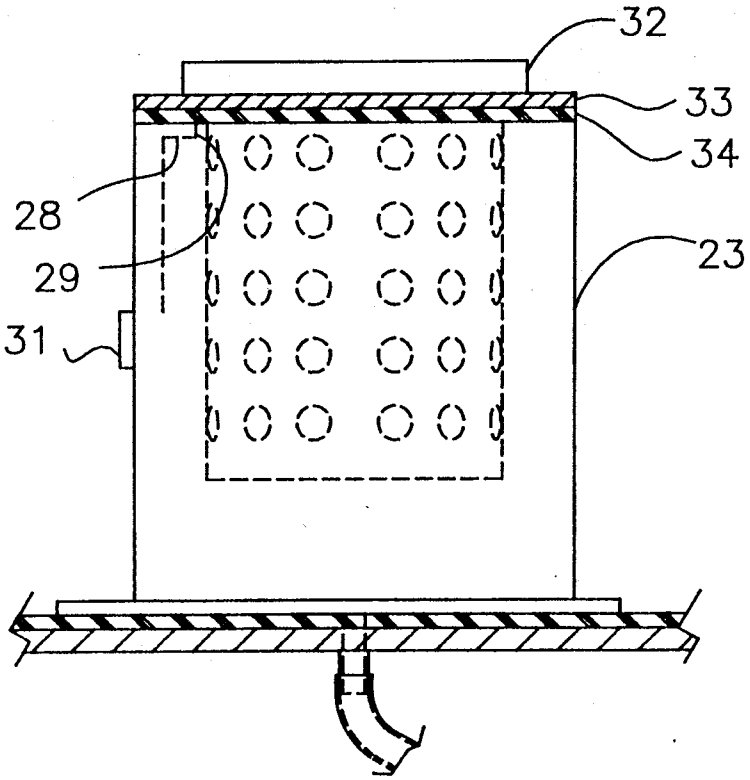

As mentioned before in page 4 line 28 FIG. 1, said, an integral flange 28 extends inwards from the lower wall of chamber 23, at the bottom chamber 23 has an opening 29 dimentioned to receive a smaller size flask. Referring to FIG. 2, chamber 23 is acting in a different mode, it has been placed on top of vacuum table 10 and directly over vacuum hole 12, in an upside-down position, a smaller size of flask 32 has been placed in the interior of chamber 23, the integral flange-33 of flask 32, is resting on the integral flange 28 (shown in phantom) of chamber 23, having therein an O type heat resistant gasket 34 to provide an air tight seal between chamber 23 and flask 32. The procedure of casting is the same as mentioned before.

Figure 3:
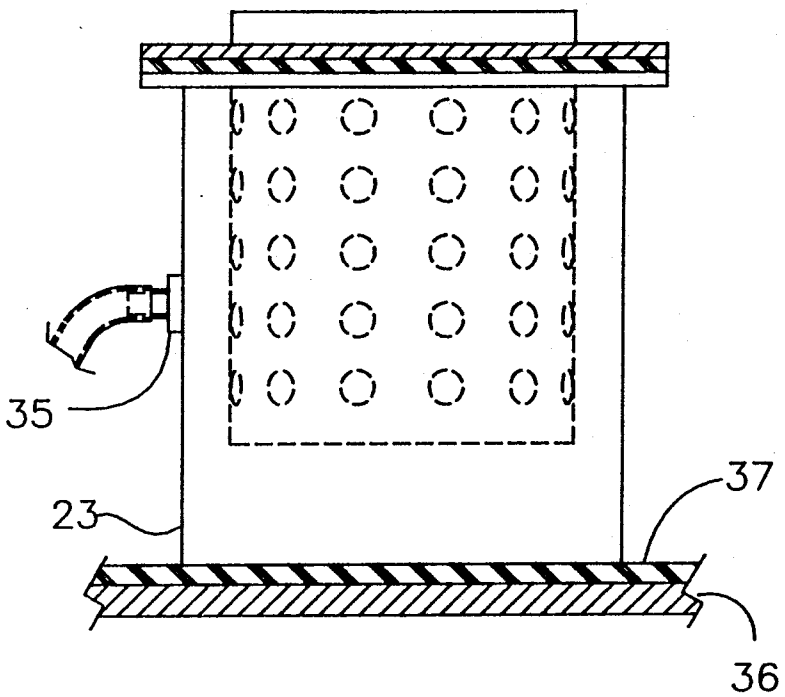
FIG. 2 and 3—Depicts a side view of the preferred embodiment of the invention in two differents modes.

FIG. 3, shown chamber 23 acting in another different mode. Plug 31 (shown in FIG. 1 and 2) has been replaced by hose fitting 35 which can be connected to any suitable vacuum source, and casting can be done in any flat surface 36 having a heat resistant gasket 37 between chamber 23 and surface 36.

While a preferred embodiment of this invention has been shown and described, it will be understood that the invention is not limited thereto. In view of the foregoing teaching, modifications can be made within the scope of this invention by one ordinary skill in the art in which this invention pertains. For example if only a vacuum source is available a sheet metal with a hole at the center can be placed on top of vacuum chamber 23, and any size of non-perforated flask can be casted, the investment slurry also can be vacuumed when placed in the interior of chamber 23 an a metal plate is placed on top of chamber 23.

Vacuum chamber 23 could be constructed of any suitable material and it could be integrated to an inexpensive vacuum system without departing from the teaching of this invention. Thus is contemplated by the appended claims to cover any modification and any others embodiment which contitutes the salient features of this invention.

What I claim is:

1. A vacuum casting machine comprising:

at least two flasks containing an investment material having mold cavities formed therein for receiving a casting material;

one of said flasks being located inside a cylindrical vacuum casting chamber;

said cylindrical vacuum chamber having first and second open ends and having at one of said an inwardly extending flange so as to removably support and form a seal with a first perforated flask in the vacuum chamber;

and further having an outwardly extending flange at said second open side of said vacuum chamber so as to removably support and form a seal with a second, larger perforated flask in the vacuum chamber when said vacuum chamber is inverted.

2. The vacuum casting machine of claim 1 wherein the casting machine comprises;

a vacuum table, vacuum pump and means to connect said vacuum table with said vacuum pump, and the vacuum chamber is arranged on said vacuum table with one of said ends detachably abutted against the table to form a seal therewith and the opposite said end is remote from said table so as to form a seal with and support a flask above the table.

3. The vacuum casting machine of claim 2 wherein said vacuum chamber further includes a hose attachment means to evacuate air from said chamber.

* * * * *